US006164365A

United States Patent [19]

Kunstreich et al.

[11] Patent Number: 6,164,365

[45] Date of Patent: Dec. 26, 2000

[54] APPARATUS FOR ELECTROMAGNETICALLY BRAKING A MOLTEN METAL IN A CONTINUOUS CASTING MOLD

[75] Inventors: Siebo Kunstreich, St Ouen; Marie Claude Nové , Paris, both of France

[73] Assignee: Rotelec (Societe Anonyme), Bagnolet, France

[21] Appl. No.: 09/205,714

[22] Filed: Dec. 4, 1998

[30] Foreign Application Priority Data

Dec. 17, 1997 [FR] France ..... 97 15984

[51] Int. Cl.[7] ..... B22D 27/02

[52] U.S. Cl. ..... 164/466; 164/502

[58] Field of Search ..... 164/466, 502

[56] References Cited

U.S. PATENT DOCUMENTS

| | | |
|---|---|---|
| 4,040,467 | 8/1977 | Alberny et al. . |
| 4,042,008 | 8/1977 | Alberny et al. . |
| 4,178,979 | 12/1979 | Birat et al. . |
| 4,495,984 | 1/1985 | Kollberg . |
| 4,590,989 | 5/1986 | Kobayashi . |
| 5,404,933 | 4/1995 | Andersson et al. . |

FOREIGN PATENT DOCUMENTS

| | | | |
|---|---|---|---|
| 5-154623 | 6/1993 | Japan | 164/466 |
| 1558526 | 3/1980 | United Kingdom . | |
| 96/26029 | 8/1996 | WIPO . | |

*Primary Examiner*—Kuang Y. Lin

*Attorney, Agent, or Firm*—Nixon Peabody LLP; Thomas W. Cole

[57] ABSTRACT

Both an apparatus and method are provided for electromagnetically braking a flow of molten metal during a continuous casting operation. The apparatus includes an electric electromagnetic inductor of the traveling-magnetic-field polyphase stator-type connected to a source of electrical power. The inductor is mounted on a casting plant opposite one face of the product being cast, and has two or three phase windings. The electrical power supply of the apparatus includes two or three elementary DC sources, each of which can be adjusted in terms of current intensity independent of one another. Each of the elementary electrical DC sources is connected to one, and only one of the phase windings of the inductor. The arrangement of the apparatus allows a flow of molten, ferromagnetic metal such as steel to be adjustably braked by merely adjusting the parameters of the source of electrical supply.

9 Claims, 6 Drawing Sheets

(Section AA)

(Section AA)

APPARATUS FOR ELECTROMAGNETICALLY BRAKING A MOLTEN METAL IN A CONTINUOUS CASTING MOLD

BACKGROUND OF THE INVENTION

The present invention relates to the continuous casting of metals, especially steel. It relates more particularly to techniques that consist, using a magnetic field, in affecting the circulation of the molten metal upon its entry into the continuous casting mold.

DESCRIPTION OF THE PRIOR ART

It is known that the jet of molten metal entering the mold creates within the latter a hydrodynamic perturbation that is often the cause of defects observed later in the rolled cast product. On the one hand, the jet entrains with it, depthwise into the liquid core of the product being cast, nonmetallic inclusions which are subsequently difficult to remove by natural settling onto the meniscus (the free surface of the molten metal in the mold). This general phenomenon is more pronounced even on casters of the "curved" or "semi-curved" type, as is the case when casting products of wide cross section, especially slabs, in which the solidification front of the inner fiber of the cast product then forms an obstacle to the rise of the inclusions which build up at this point. On the other hand, the recirculation movements of liquid metal that are generated by the jet within the mold result, inter alia, in rising disturbances which agitate the meniscus in a random fashion, this occurring, moreover, more vigorously the higher the casting rate (i.e. above approximately 1.5 m/min. in order to be more specific). Such surface instabilities are responsible for solidification irregularities in the first shell of the cast product around the perimeter of the mold which are known to be the cause of undesirable, or even unacceptable, defects in the end product (blistering, peel-off, etc.).

Faced with the problem posed by this hydrodynamic perturbation due to the jet, steelmakers at the present time have two solutions, each of which makes use of tools available from magnetohydrodynamics adapted to the continuous casting of metals.

One of them, which is more of a "curative" approach, aims to reduce the effects on the metallurgical quality of the product obtained, namely electromagnetic convection (or stirring). The other, of a preventative nature, is employed to counteract this perturbation, namely electromagnetic braking.

Electromagnetic convection consists in causing the solidification front to be washed by a forced current of cast liquid metal, moving upwards for example, which carries away with it, toward the meniscus, the nonmetallic inclusions which otherwise would be trapped by this front. This current of liquid metal is created by a traveling magnetic field generally produced by a multi-winding inductor of the polyphase (two- or three-phase) linear-motor stator type arranged so as to be parallel with and opposite a large face of the inmold slab (BF 2358222 and BF 2358223). An inductor of this type conventionally consists of electrical windings whose conductors are shaped in the form of uniformly spaced parallel bars, or in the form of wire coils, these being housed in the teeth of a magnetic yoke and mounted in pairs in series-opposition. Each winding is connected to a different phase of a polyphase electrical supply, namely a three-phase or two-phase supply, in a connection sequence providing the desired traveling of the magnetic field along the inductor in a direction perpendicular to the conductors. This type of multi-winding inductor, capable of producing a traveling magnetic field by coupling with a polyphase supply, is extensively described in the electrical engineering literature.

The technique of "electromagnetic braking", within which the present invention falls, consists, on the other hand, in acting directly on the jet or jets of metal entering the mold. Thus, the aim is to limit the depth of penetration thereof, as well as to attenuate the induced recirculation movements of the liquid metal and therefore to tend toward the formation of an unagitated meniscus that is as calm and as flat as possible. The operation of such a brake follows the well-known principle of eddy-current braking; when a moving liquid metal (more generally an electrically conductive fluid) passes through a static magnetic field it is subjected by it to a counteractive force whose intensity depends on that of the field and on the velocity of the metal.

An electromagnetic brake for molds for continuously casting slabs is known which essentially consists of two salient-pole electromagnets facing each other on each side of the large walls of the mold and of opposite polarity so as to create traveling magnetic lines of force between the poles. The electromagnets are positioned in the top part of the mold so as to intercept the jet of metal as soon as it enters the mold. It should be emphasized that, strictly speaking, the liquid steel entering the mold and subjected to such a field is not actually braked, but rather reoriented and distributed in the available volume nearby. This is because, overall the flow rate of the cast metal, and therefore the rate of casting of the product, are, happily, not modified by the brake. This in fact acts as a flow distributor conferring much greater homogeneity on the velocity map of the flow in the top of the mold. The term "electromagnetic braking" is therefore strictly speaking improper, but it will continue to be used hereafter for the sake of convenience and in order to conform with the common practice. A brake of this type is described, for example, in document EP-A-0,040,383, which recommends the use of four electromagnets coupled two by two in pairs placed opposite each other on the large walls of a mold for continuously casting slabs, one pair being placed on each side of a pouring nozzle having two lateral outlets for the feed jets directed at the side walls of the mold.

Document PCT WO 92/12814 proposes to reinforce the braking effect by replacing, on each large wall, the two electromagnets by a bar magnet over the entire width of the mold and to locate this bar heightwise level with the lateral outlets of the pouring nozzle so as to produce a permanent braking action throughout the propagation of the jet leaving each outlet of the nozzle in the direction of the side walls.

More recently, document PCT WO 96/26029 teaches placing, not one, but two bar magnets per wall, these being located heightwise at different levels, one beneath the other on each side of the outlets of the nozzle so as to create a magnetic confinement of the jet region in order to hydrodynamically isolate it from the rest of the volume of liquid metal present in the mold. However, as is known, the in-mold flow conditions of the liquid metal may vary markedly from one casting run to another, or indeed during the same casting run, depending on various parameters, such as the casting rate, the depth of immersion of the nozzle, the shape of its outlets providing the direction of the jet, the width of the mold, if this is of the variable-width type, etc. Consequently, if it is desired to optimize the regions of action of the magnetic field in the mold depending on these parameters, this cannot be accomplished without moving the inductor along the large walls of the mold, something which is unrealizable in practice.

SUMMARY OF THE INVENTION

The object of the invention is to provide steelmakers with a means for easily and instantly modifying the regions of action of an electromagnetic brake in a continuous casting mold so as to be able to permanently tailor their positions to the precise conditions of the casting run to come, or to the casting run in progress, simply by adjusting the parameters of the electrical supply, and therefore without requiring any intervention on the caster, and especially without having to modify the position of the inductor or inductors.

For this purpose, the subject of the invention is an apparatus for electromagnetically braking a molten metal within a continuously cast product, in particular a slab, comprising an electrical supply and, connected to said supply, at least one electromagnetic inductor of the "traveling-magnetic-field polyphase stator" type intended to be mounted on the casting plant opposite one face of the product being cast, said inductor having two or three phase windings, in which apparatus said electrical supply consists of two, or alternatively three, elementary DC supplies, each of which can be adjusted in terms of current intensity independently of one another, and in which each of said elementary electrical supplies is connected to one, and only one, of said phase windings of the inductor.

As will doubtless have been understood, the invention consists in combining an inductor of the "traveling-magnetic-field linear-motor stator" type—the design and structure of which have been widely known for a long time and the use of which in the continuous casting of slabs, as a means of moving the molten metal vertically in the mold (cf. for example GB 1,507,444 and 1,542,316), is also well known—with a bank of individual DC supplies, that can be adjusted independently of one another and each coupled to a winding of the inductor, and to it alone, so as to create a static magnetic field which can be adjusted in terms of location (and, of course, also in terms of intensity) along the height or width of the large walls of the mold (for that matter, more generally at any chosen point along the metallurgical height, but provided that the cast product at this point still contains a moderate amount of unsolidified liquid metal in the core) by selectively activating the windings of the inductor simply by adjusting the operating parameters for these elementary supplies, namely in fact the intensity of the electric currents that they deliver. These adjustments can be made instantly, during the casting run itself, if necessary remotely from the caster, so as to be completely safe for the operators and totally transparently, that is to say without any risk of disturbing, even minimally, the proper execution of the casting operation.

Thus, the subject of the invention is also a process for electromagnetically braking a liquid metal within a continuously cast product, according to which a permanent magnetic field acting on the liquid metal is used to brake its flow, said field being created by a braking apparatus having a multi-winding electromagnetic inductor of the "traveling-magnetic-field polyphase stator" type coupled to elementary DC electrical supplies that are individually adjustable in accordance with the equipment defined above, wherein, for the purpose of adjusting, depending on the casting conditions, the position of the magnetic pole or poles of said inductor without moving the latter, the intensities $I_i$ of the electric currents flowing through the windings of the inductor are adjusted using a factor $\phi$, which varies between 0 and $\pi$ radians, so that, at each instant, $I_1=K \cos \phi$ and $I_2=K \sin \phi$ in the case of an inductor having two windings and $I_1=K \sin \phi$, $I_2=K \sin (\phi+2\pi)$ and $I_3=K \sin (\phi+4\pi/3)$ in the case of an inductor having three windings, K being a constant representative of the desired braking force at the position of the magnetic pole or poles of the inductor and the maximum value of K being limited by the maximum intensity of the electric current able to be delivered by each elementary electrical supply.

DESCRIPTION OF THE DRAWINGS

The invention will be well understood, and other aspects and advantages will become clearer, in the light of the following description given solely by way of nonlimiting illustrative example and with reference to the appended plates of drawings, in which.

In these figures, the same elements are denoted by identical references.

DESCRIPTION OF THE PREFERRED EMBODIMENTS

Figure 1:
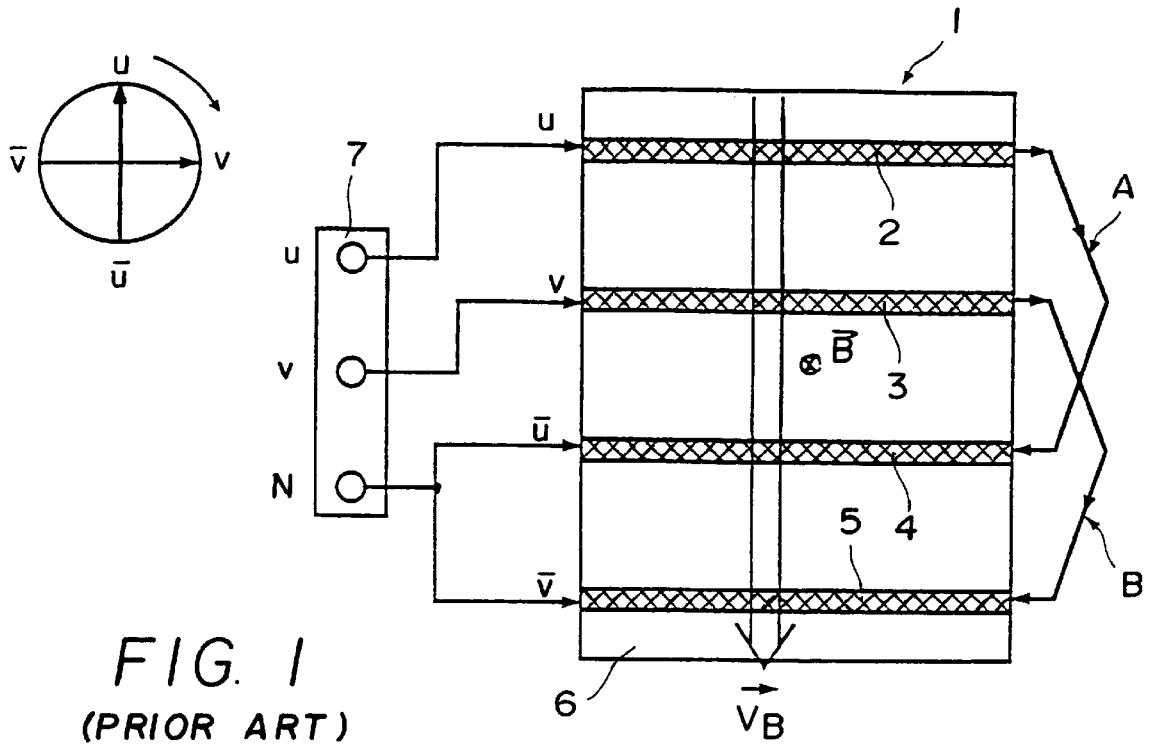
FIG. 1 (PRIOR ART)
FIG. 1 shows diagrammatically a two-phase electromagnetic inductor of known type for stirring the metal poured into a continuous casting mold and elements of which will again be shown in the braking apparatus according to the invention.

The operation of the stirring inductor 1 shown in FIG. 1 and its effects on the flows of liquid metal are completely different from those of the braking device of the invention, but it does serve as a kind of framework to the construction of this device. It therefore has close constructional similarities with it. In addition, a few reminders with regard to it and with regard to its method of operation will make it easier to understand the invention.

The main active part of this traveling-field static inductor consists of electrical conductors, in this case straight copper bars 2, 3, 4 and 5 housed in uniformly spaced parallel notches or (teeth) made in a magnetic yoke 6. These bars are thus arranged so as to be mutually parallel and uniformly separated from each other by a distance which makes it possible to define the pole spacing of the inductor.

In the example in question, the inductor is of the two-phase stator type. For this purpose, it comprises four conducting bars mounted electrically two by two, in pairs in series-opposition, i.e. connected by their ends located on the same side of the inductor (on the right-hand side in the figure) so that the electric current flows in opposite directions therein. Each pair of bars, 2–4 or 3–5, forms a winding whose free ends (on the left-hand side in the figure) are connected, in the order shown in the figure, to the terminals of a twophase supply 7, the two phases of which are conventionally identified by the letters U and V and the neutral of which by the letter N. These free ends are denoted by the same letters, U or V, as those of the phase which supplies them, the current input ends being distinguished from the current return ends by the letters having a horizontal line placed over them, in accordance with common practice. As may be seen, these windings here are of the "imbricated" type, since the coupled bars forming a winding are not adjacent bars but bars separated by one bar of the other winding. Thus, the bar 2 is connected to the bar 4 in order to form the winding A and the bar 3 is connected to the bar 5 in order to form the other winding B. Similar arrangements are also found in the case of an inductor of the three-phase stator type, the imbrication of the three windings then being obtained, as is known, by a jump in the separation between coupled bars, not of one bar, but of two bars, each one belonging to one or other of the two other windings.

When the inductor 1 is supplied by an AC supply, the electrical circuit diagram of which is that shown in FIG. 1, the electric current flowing in the bars 2, 3, 4, 5 produces a magnetic field perpendicular to the plane of the figure and traveling from one bar to the next in the direction perpendicular to the orientation of the bars (this direction being shown by the arrow $V_B$ in the figure), namely from the top down, and this being so at the rate (i.e. the frequency of the current) with which the intensity of the supply current reaches its maximum successively from the bar 2 down to the bar 5. The little "inset" diagram on the left-hand side of the figure shows, by means of the trigonometric circle, the dynamic organization of the two phases which will provide a simple understanding of what has just been stated on going clockwise around this circle. A stirring inductor of this kind may be readily placed within a continuous casting mold, for example for casting slabs, and many documents, especially in the form of patent applications, describe such a use.

The invention, which will now be described, corresponds perfectly with what has just been stated in terms of inductor structure, of conductor coupling in order to form the windings, or of integration of the inductor into a continuous caster.

Figure 2:
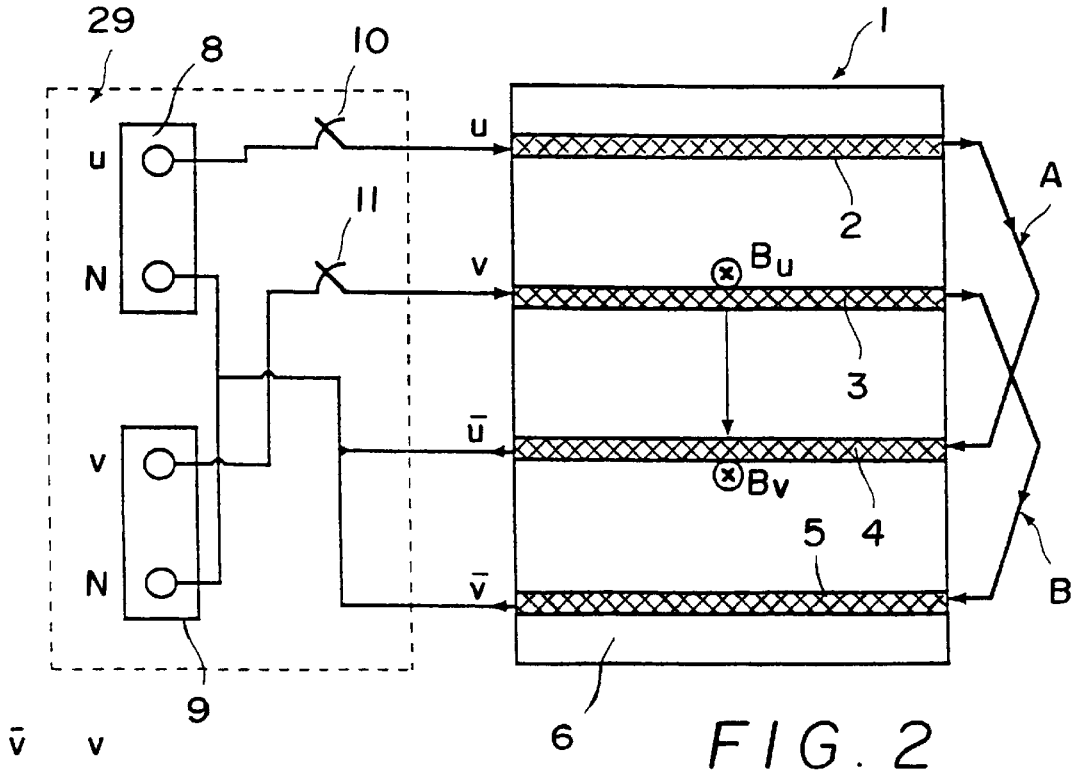
FIG. 2 shows diagrammatically an electromagnetic braking apparatus according to the invention in a two-winding embodiment similar to that of the known two-phase stirring inductor in FIG. 1.

In order to construct the electromagnetic braking apparatus according to the invention, as shown in FIG. 2, the inductive device in FIG. 1 must be modified so that it no longer produces a moving magnetic field but a permanent stationary field which is located at a chosen point on the inductor but which can be modified at will. This static field will therefore be produced from a DC electrical supply. It is therefore similar to that produced by the known electromagnetic braking devices in continuous casting molds, but the region where it acts can be adjusted in terms of position over the height of the mold (or over the width, depending on the set-up adopted) without any alteration to the caster.

As may be seen in FIG. 2, this modification consists in replacing the two-phase supply 7 by two individual and mutually independent DC supplies 8 and 9, it being possible for their single common point to be their neutral N, which is made common for the sake of convenience. These supplies are each provided with means of adjusting the intensity of the currents that they deliver. These adjustment means, known per se and entirely standard in this field, have therefore simply been illustrated by the respective elements 10 and 11 in the figures. The inductor 1 has not been modified in any way the connections between conductors defining the windings A and B remain unchanged.

The apparatus according to the invention is in the operating state as soon as each of the windings A and B of the inductor 1 is connected to one of its two elementary supplies, and only to one. In the example illustrated in FIG. 2, the winding A is connected to the supply 8 and the winding B is connected to the supply 9.

Applied to a continuous casting mold, such an apparatus therefore produces the desired braking effect in order to reduce the depth of penetration of the jet and its undesirable effects on the internal quality of the cast product obtained after complete solidification. Moreover, it will be noted that the braking apparatus of the invention can in fact also be applied below the mold and therefore can be used, more generally, on a continuously cast product, for example a steel slab, whose interior is still in the decidely liquid state.

Figure 3:
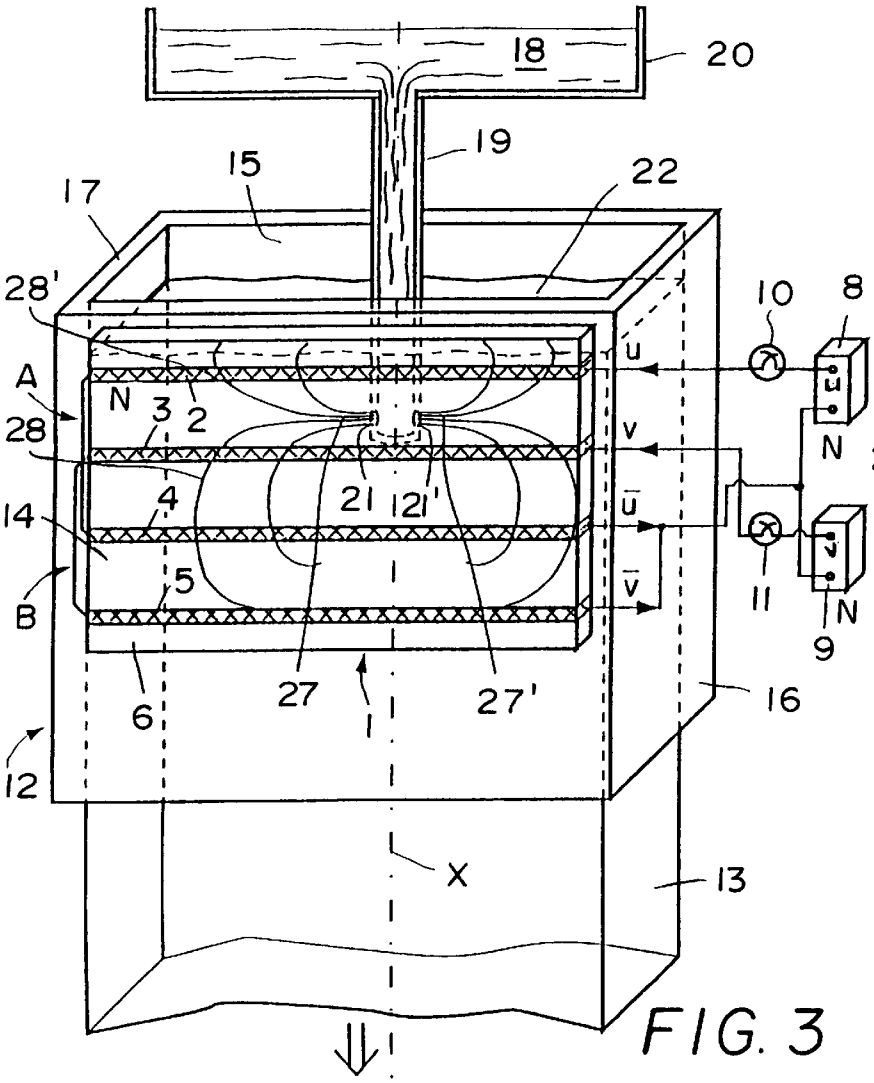
FIG. 3 shows an inductor for the braking apparatus according to the invention in accordance with FIG. 2, as it appears when it is mounted in the body of a mold for continuously casting steel slabs according to a first method of adjusting the height at which the braking action occurs.

At this stage in the description, reference should be made to FIG. 3 which specifically shows the inductor of the braking apparatus according to the invention fitted to a large wall of a continuous casting mold 12 for steel slabs 13. Of course, both of the opposed large walls of the mold may be thus equipped, using two identical inductors placed opposite each other on each side of the cast product and each extending over substantially the entire width of the mold. The rest of the description will show that, depending on the choice of the polarities on one of the inductors with respect to the other one facing it, it is possible to induce the braking effect right through the thickness of the cast product (the so-called "cross" field configuration) or to localize it near the shell only (theso-called "longitudinal" field configuration.

A mold for continuously casting slabs essentially consists, as is known, of an assembly of four vertical plates, made of copper or of copper alloy—two large plates 14 and 15, called "large walls" together with two end plates 16 and 17 closing off the ends and called "side walls". These plates together define a bottomless casting space for the molten metal 18 entering from above via a nozzle 19 mounted in the bottom of a tundish 20 placed above them. They are cooled intensely on the outside by a vigorous circulation of water in order to extract the heat necessary for the formation of a metal shell, that has solidified on contact with them, sufficiently thick to allow the cast product to be extracted under the proper operating conditions. The molten metal is poured into the mold by the nozzle 19 whose lower end, provided with lateral outlets 21, 21', is immersed in the mass of molten steel already in the process of being cast that is present in the mold. These lateral outlets each deliver a jet 27 and 27' of molten metal directed at the side walls of the mold, and near which side walls a separation is made between a descending main flow 28, responsible for the depthwise entrainment of nonmetallic inclusions, and an ascending flow 28' which agitates the meniscus 22. It is on these jets 27 and 27' that the braking means according to the invention will act.

In the example illustrated in FIG. 3, the inductor 1 described above is mounted so as to face a large wall 14 of the mold in an orientation such that the conducting bars 2 to 5 are horizontal, the casting axis X itself being vertical. Under these conditions, if reference is again made to FIG. 2 in order to consider just for the moment the supply 8, the direct current that it delivers to the winding A (its intensity being set by its adjustment means 10) forms a current loop located in the top half of the inductor 1 (and therefore of the mold) and in which the electric current flows through the conducting bar 2 from the left to the right, then through the bar 4 from the right to the left. A stationary magnetic field $B_u$ is thus created in the region defined by the area of this current loop, said magnetic field being perpendicular to the plane of the winding, which plane in this case is also that of the figure. It will be understood that what is thus formed in the top of the mold, and over the entire width of the latter, is a stationary magnetic field $B_u$ perpendicular to the direction of casting X and perpendicular to the plane of distribution of the velocities of propagation of the jets of metal 27, 27', the maximum intensity of which lies at the center of the winding A, i.e. at the height of the passive bar 3 of the winding B. If we now consider in the same way just the supply 9 and the winding B which it supplies with current, a magnetic field $B_u$, is obtained which is identical to the previous field $B_u$, but whose maximum this time lies level with the passive bar 4 of the winding A.

Figure 5B:
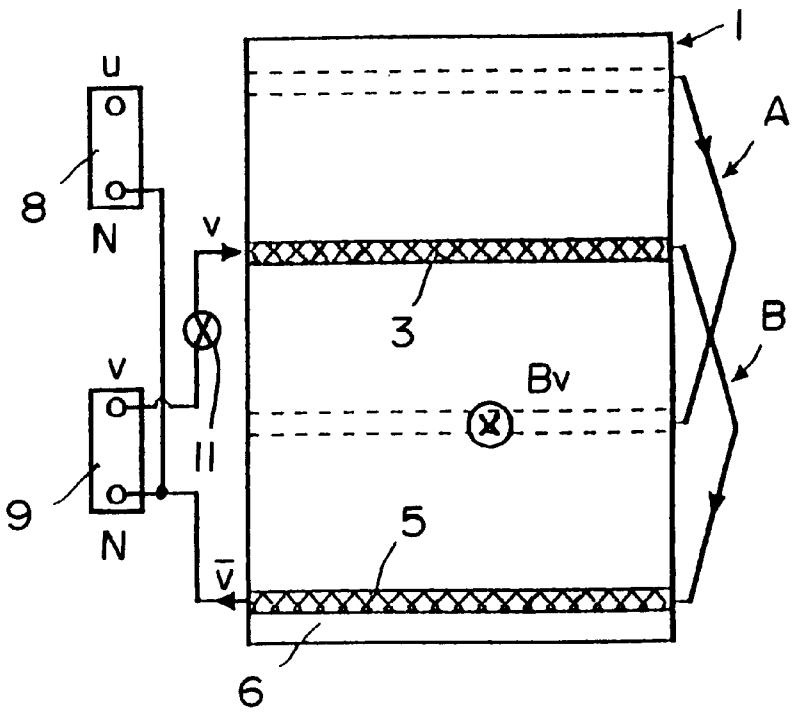
FIGS. 5*a* and 5*b* each illustrate a method of using the braking apparatus according to the invention in a different embodiment of the inductor.
Figure 5A:
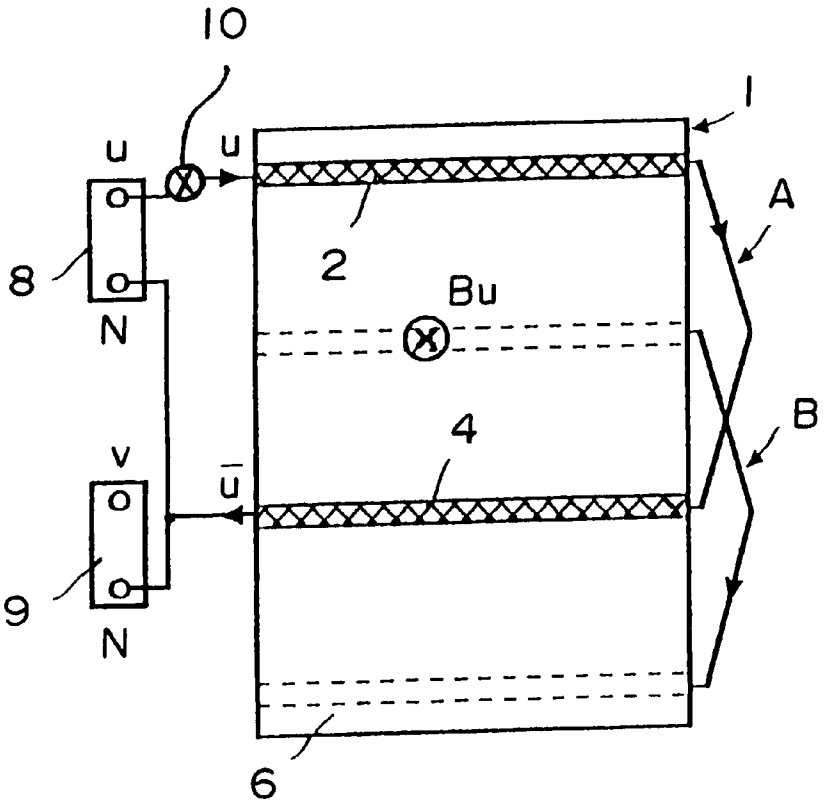

If both electrical supplies deliver current at the same time to their respective windings, the fields $B_u$ and $B_v$ are present at the same time and the existence between the bars 2 and 3 of an overlap region, which here is due to the fact that the windings A and B are imbricated, means that these fields are additive in this region. The maximum magnetic induction, and therefore the maximum braking effect, is therefore obtained in the core of this central region if the supply currents are of the same intensity. On the other hand, this maximum will be achieved at the center of the winding A if the individual supply 9 is left inactive (see FIG. 5*a*) or at the center of the winding B if the individual supply 8 is left inactive (see FIG. 5*b*), or else at an infinity of possible locations between these two extreme positions simply by setting, using the adjustment means 10 and 11, an intentional current imbalance between the two supplies 8 and 9 which are then jointly active (FIG. 2). For the sake of simplicity, we will call here "magnetic pole" the point in the space (in this case, one of the large walls of the mold provided with a braking inductor) where the braking magnetic field is a maximum.

Thus, this inductor 1 can operate as a brake acting on the flows of molten metal entering the mold, in the manner of the known electromagnetic braking devices. However, in the present case it is decidely advantageous to have the benefit of being able at any instant to adjust the position of the magnetic pole of the braking field over the height of the mold, without having to move any component of the inductor, simply by adjusting the electrical supplies.

As already stated, a precise position of the magnetic pole of the braking field in the upper part of the mold may in fact be optimal under certain casting conditions but prove to be much less well suited than another if casting parameters, such as the immersion depth of the nozzle 19, the level of the meniscus 22 in the mold, the casting rate, etc., are modified from one casting run to the next or during the casting run itself. It is then necessary to be able to modify the position of this pole over the height of the mold. As has just been seen, this becomes very easy with the device of the invention since it is merely a question of adjusting the electrical operating parameters of the supply.

Figure 4:
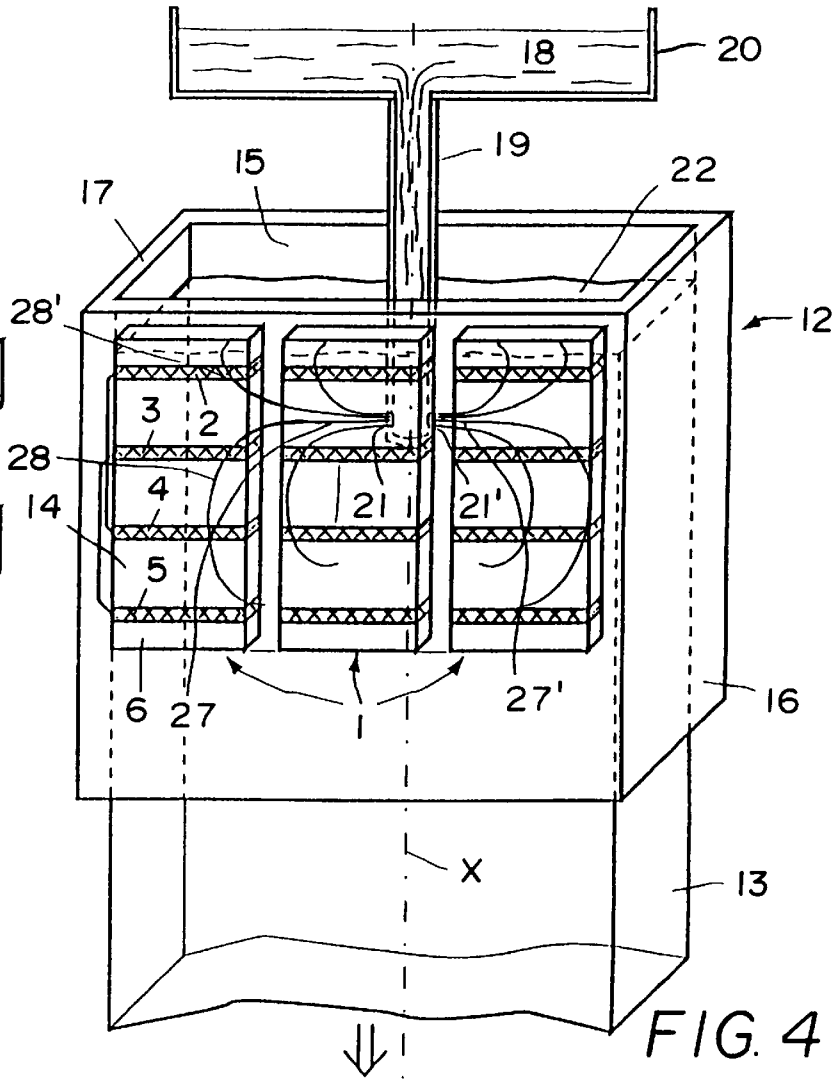
FIG. 4 shows an alternative form of the plant in FIG. 3, according to which the structure of the braking inductor is divided over the width of the mold.

As may be seen in FIG. 4, it is possible to "clad" the large walls of the mold not with a single inductor over the entire width but with three functionally equivalent inductors 1*a*, 1*b*, 1*c* placed side by side over the width of the large walls of the mold, and thus to be able to modulate the actions of the electromagnetic braking on the cast metal differently in the central position and on the sides of the large walls.

It will have been understood that, instead of covering the entire width of the mold, the braking inductor according to the invention may involve only a fraction of this width. For example, what may be involved is only the central part, or only the lateral parts on each side of the nozzle 19, or else, as already stated with reference to FIG. 4, the entire width, but by means of independent successive regions of action using several juxtaposed inductors. It is then possible to adjust the intensity of the braking action at the magnetic pole differently depending on the width of the cast slab simply by using electric supply currents of different intensities in each inductive module thus formed. Likewise, it is possible to position the magnetic braking pole heightwise at levels which differ depending on whether the inductor is at the center or rather to the sides of the large wall of the mold. Likewise too, it thus becomes possible in a mold of variable format to tailor the region of action of the magnetic braking field to the width of the cast product.

In general, if a chosen constant representative of the desired braking force at the point of the magnetic pole of each inductor is called "K", the maximum value of which is limited by the maximum intensity of the electric current that can be delivered by the elementary supplies 8, 9, etc., the desired position of this magnetic pole may be adjusted, by acting on the adjustment means 10, 11, etc., simply by varying, between 0 and $\pi$ radians, an adjustment parameter p which functionally links together the elementary supplies so that the intensities $I_i$ of the current passing through the windings are given by the equations $I_1=K\cos\phi$ and $I_2=K\sin\phi$ in the case of an apparatus having two elementary supplies (two separate windings per inductor) or according to the equations $I_1=K\sin\phi$, $I_2=K\sin(\phi+2\pi/3)$ and $I_3=K\sin(\phi+4\pi/3)$ in the case of an apparatus having three elementary supplies (i.e. having three separate windings per inductor).

Figure 7:
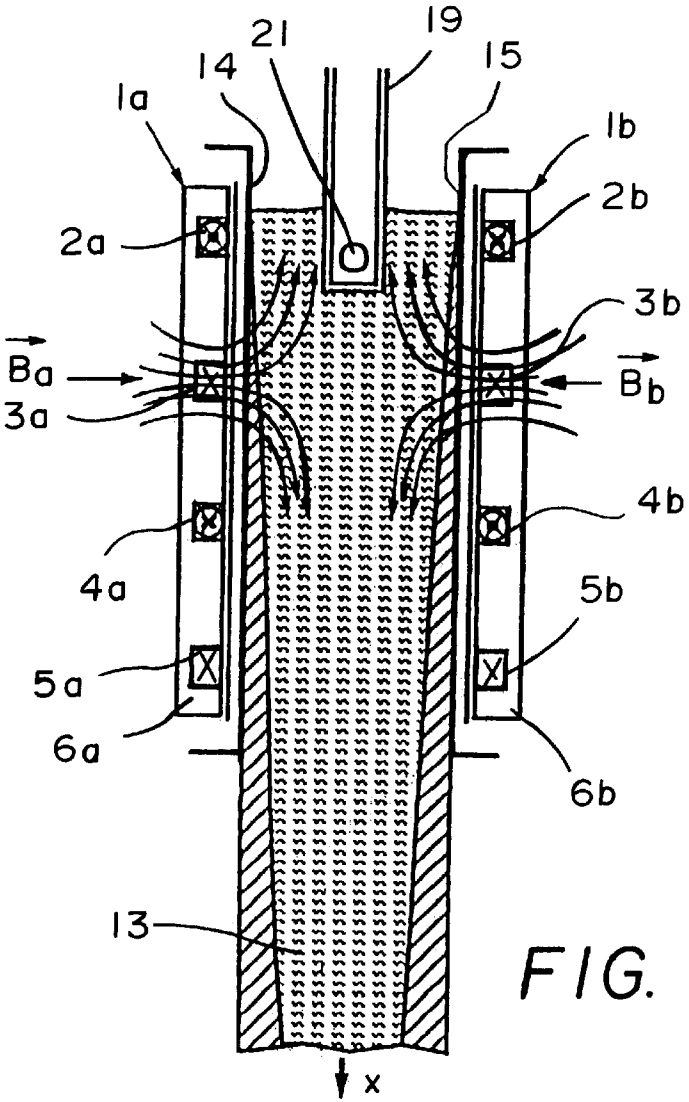
FIG. 7 is a view similar to FIG. 6, but illustrating another method of adjusting the braking apparatus according to the invention.
Figure 6:
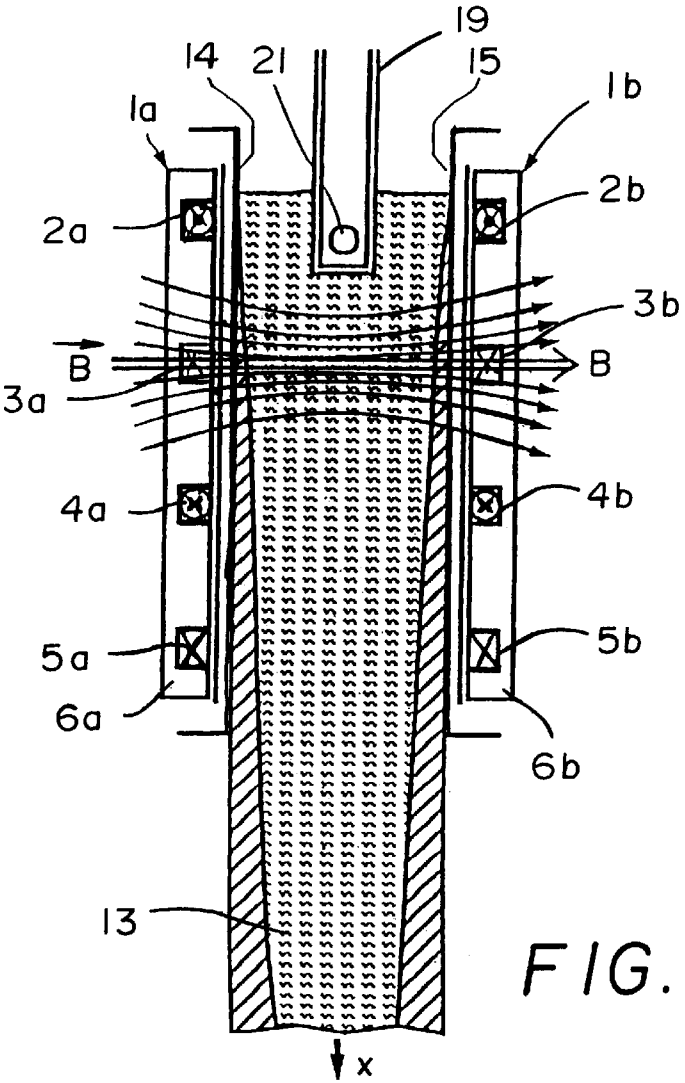
FIG. 6 is a diagrammatic view, in vertical cross section passing through the casting axis X in FIG. 3, of the apparatus according to FIG. 3 illustrating one method of adjusting this apparatus.

It will also have been noted that an inductor 1 or 1' of the braking apparatus according to the invention may be mounted so as to face each of the large walls of the mold. It is then possible, by varying the polarities of the active windings at the same time on each side of the cast slab, to enhance the braking action at the center of the cast product, or to concentrate it near the shell. These arrangements form the subject of FIGS. 6 and 7 in which the inductor 1 has been given the suffix "a" in order to distinguish it from the similar inductor on the other wall of the mold, which is given the suffix "b". Magnetic fields of the same orientation in the two facing inductors will mutually reinforce each other in the "cross" direction and therefore will enhance the braking action in the core of the cast metal (FIG. 6), whereas opposed magnetic fields will counteract each other in the core of the metal and will consequently concentrate their braking action at the periphery of the cast metal, necessarily adopting a configuration of the "longitudinal field" type (FIG. 7).

It goes without saying that the invention is not limited to the embodiments exemplified above but extends to many variants or equivalents provided that its definition given in the appended claims is respected.

Figure 8:
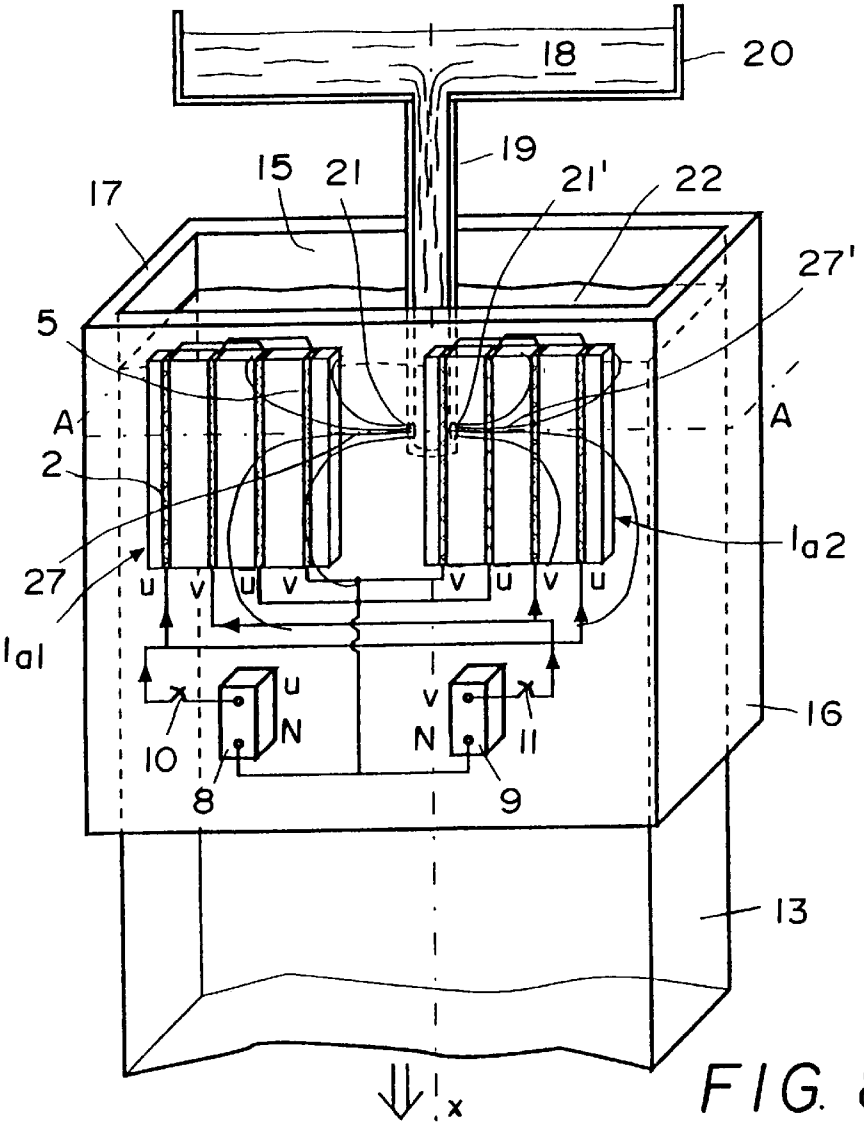
FIG. 8, similar to FIG. 3, shows a braking apparatus according to the invention mounted on a mold for continuously casting steel slabs according to a second method of adjusting the braking action over the width of the mold.

Thus, as shown in FIG. 8, the inductor 1 al may be mounted on the mold with its conducting bars 2 . . . 5 oriented parallel to the casting axis X, that is to say vertically, instead of horizontally. At a given vertical level, it is then possible to modify the position of the braking action of the magnetic field over half the width of the cast product with the desired accuracy along the propagation of the jet of metal 27 coming from the outlet 21 of the pouring nozzle 19. By then using two such inductors $\mathbf{1}_{a1}$ and $\mathbf{1}_{a2}$ with vertical conductors placed on a large wall of the mold on each side of the nozzle 19, there is complete freedom to set the position of the magnetic braking poles precisely at the desired distance from each of the outlets 21 and 21' of the nozzle. In addition, the options are widened further by using two other similar inductors on the other large wall of the mold, since it is then possible, as has already been seen previously, to concentrate the action of the field at a chosen point in the thickness of the product, namely in the core rather than at the periphery, or vice versa.

Figure 9:
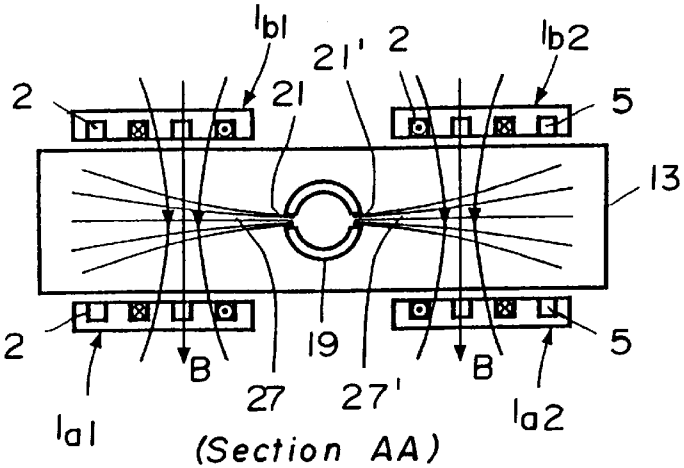
FIG. 9 illustrates, seen diagrammatically from above and in cross section on the plane A—A in FIG. 8, a method of adjusting the braking apparatus shown in FIG. 8.

FIG. 9 shows the method of adjusting an apparatus having two pairs of inductors of this type, providing a braking effect over the entire thickness of the cast product 13. As may be seen, the principle of such an adjustment is extremely simple. In the active windings which face each other, all that is required is for the electric current to pass in the same direction through the conductors facing each other on each side of the cast product. This is because, under these conditions, the magnetic fields produced by these windings in the cast liquid metal are additive; the lines of force pass through the product substantially perpendicular to its wall without deviating from their initial path taken in the inductors. The situation is therefore one of a so-called "cross field" configuration which creates a braking effect over the thickness of the cast product and therefore in particular in the center. It will be understood that there may be advantage in this case in preferably activating the windings closest to the outlets 21 and 21' of the nozzle 19 since the jets 27 and 27' are more powerful and closely confined as they leave the nozzle, whereas they are more diffuse and opened out as they progress toward the side walls of the mold.

Figure 10:
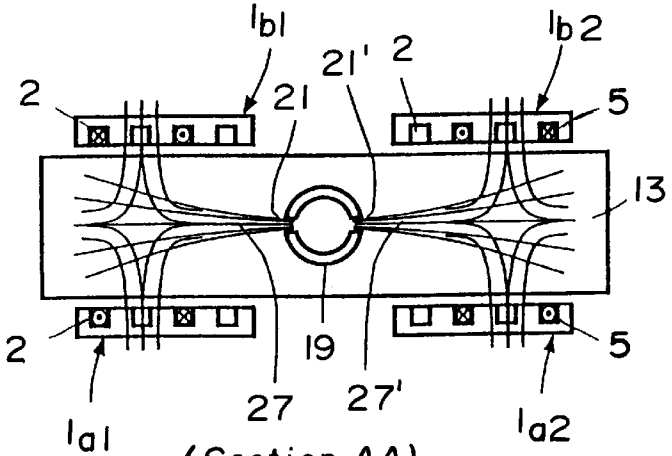
FIG. 10 illustrates, with the same arrangements as in FIG. 9, another method of adjusting this apparatus.

FIG. 10 shows this same apparatus, but set, on the contrary, so as to maximize the braking action at the shell of the cast product. For this purpose, as may be seen, all that is required is to reverse the direction of the current in one of the two active windings facing each other, so that the magnetic fields produced by these two windings are in opposition. The situation is then one of being in a "longitudinal field" type configuration—the magnetic induction is a minimum at the center of the product since its lines of force are strongly bent through 90° in the central mid-plane of the product with respect to their initial direction taken in the inductors. Since only the field component perpendicular to the lines of flow of the jets 27, 27' acts on the latter, the braking effect will then be a maximum against the solidification front of the cast metal at positions lying precisely opposite the activated windings of the inductors.

Figure 12:
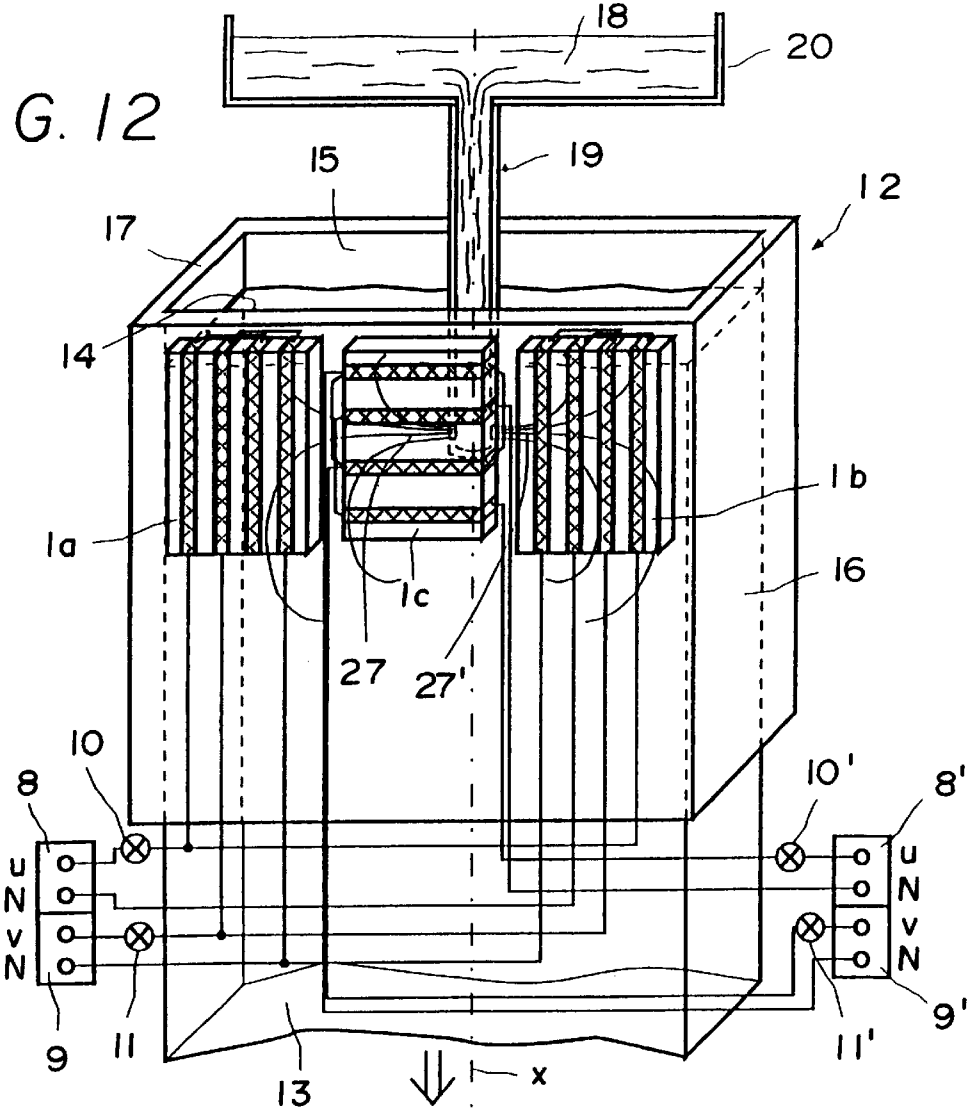
FIG. 12, similar to FIGS. 8 and 4, shows a braking apparatus according to the invention mounted on a mold for continuously casting steel slabs according to a third method of adjusting a conjugate braking action over the width and over the height of the mold.

As a variant, as shown in FIG. 12, it is possible to use inductors juxtaposed over the width of the large wall of the mold and having different orientations of their electrical conductors between them. In the example shown in this figure, three inductors are placed side by side, one 1*c* in a central position in the region of the pouring nozzle 19 and the other two, 1*a* and 1*b*, in lateral positions on either side of the central conductor 1*c*. The conductors of the latter are oriented horizontally, that is to say perpendicular to the casting axis X, so as to be able to adjust, heightwise, the position of its magnetic braking pole so as to be level with the point where the poured metal enters the mold. The conductors of the lateral inductors are, on the other hand, oriented vertically in order to be able to adjust, over the width of the large wall, the position of their magnetic braking pole so as to be near the side walls of the mold. Of course, these relative arrangements may be reversed so as to allow heightwise adjustment near the side walls and widthwise adjustment near the point of entry of the metal into the mold.

Figure 11:
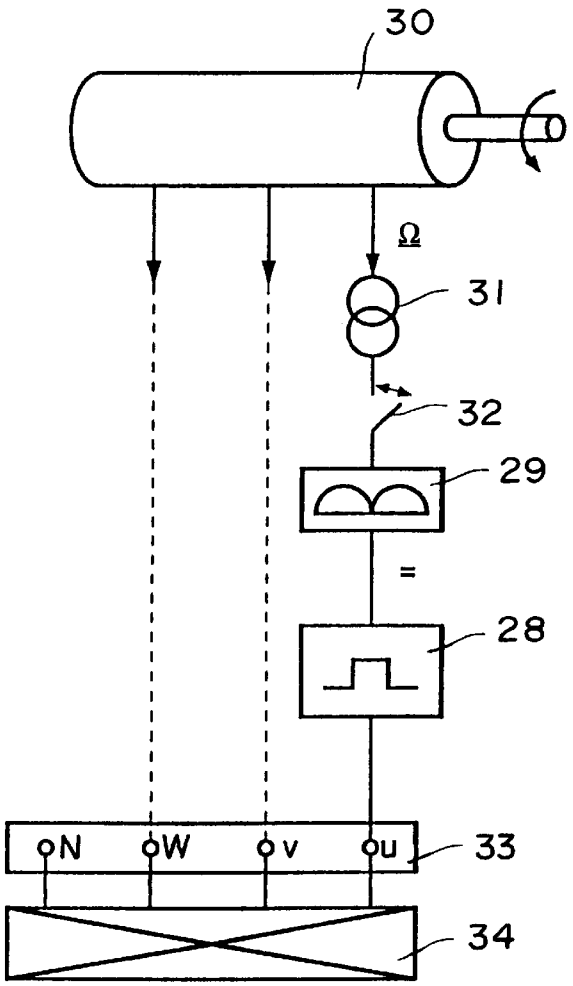
FIG. 11 shows diagrammatically an alternative form of an electrical supply of the invention.

Furthermore, the expression "elementary DC supplies", used throughout the description to qualify one of the essential characteristics of the invention, should be understood to mean not only an addition of structurally independent individual supplies, such as those used up to now with reference to the previous figures, but also a single frequency-adjustable polyphase supply having two or three phases, which is set to zero frequency in order to obtain a direct current. Polyphase electrical supplies of this type are well known. They are normally used to energize electric motors having a rotating or traveling magnetic field. As shown in FIG. 11, they are of the type having an inverter 28 with an adjustable chopping threshold. This inverter is conventionally supplied with current rectified by a rectifier 29 connected to the output of a rotating generator set 30 via a voltage-matching transformer 31 and a switch 32.

Each phase U, V and W of the supply (a three-phase supply in the example in question) is constructed in this way. The inverter ensures the phase shifts between the phases produced by the generator set 30 are respected and all of the phases of the supply are made available for use by means of a connection box 33 provided with a common neutral N.

In accordance with the invention, putting such an electrical supply into operation in order to supply the windings of the braking device shown diagrammatically at 34, with one phase per winding, consists in setting the inverter 28 to the zero frequency, and carrying out such adjustments at chosen moments so that the intensities of the currents in each phase are, at these moments, those that it is desired to obtain in the windings connected to these phases.

What is claimed is:

1. An apparatus for electromagnetically braking a molten metal within a continuous casting plant, comprising an electrical supply, a traveling-magnetic-field polyphase stator electromagnetic inductor adapted to be mounted on the casting plant opposite a face of a product being cast, said inductor having at least two phase windings, and said electrical supply having at least two elementary DC supplies, each supply being independently adjustable with respect to the other supply with respect to current intensity, and wherein each of said elementary supplies is connected to one, ad only one, of said phase windings of the inductor.

2. The apparatus as claimed in claim 1, wherein said electromagnetic inductor is adapted to be mounted in a mold of the casting plant.

3. The apparatus, as claimed in claim 1, comprising at least two opposing electromagnetic inductors adapted to be mounted on the casting plant on each side of a product being cast.

4. The apparatus as claimed in claim 1, comprising at least two inductors placed side by side from one another and adapted to be positioned over a face of a product being cast.

5. The apparatus as claimed in claim 1, comprising at least one inductor adapted to be mounted on the casting plant with conductors oriented perpendicular to a casting axis.

6. The apparatus as claimed in claim 1, comprising at least one inductor adapted to be mounted on the casting plant with conductors oriented parallel to a casting axis.

7. The apparatus as claimed in claim 4, comprising three inductors adapted to be mounted on the casting plant and having conductors oriented in different directions from one adjacent inductor to another.

8. The apparatus as claimed in claim 1, wherein the elementary electrical supplies include a single polyphase supply with at least two phases, each of which is operable at an adjustable current frequency.

9. A process for electromagnetically braking a liquid metal within a continuous casting plant, wherein a permanent magnetic field acting on the liquid metal is used to brake its flow, comprising the steps of creating said field by a braking apparatus according to claim 1, and adjusting, depending on casting conditions, a position of a magnetic pole or poles of said inductor without moving said inductor by adjusting an intensity $I_1$ of electric current flowing through windings of the inductor in accordance with a factor $\rho$, which varies between 0 and $\pi$ radians, such that, at each instant, $I_1=K \cos \pi$ and $I_2+K \sin \rho$ in the case of an inductor having two windings, and $I_1=K \sin \pi$, $I_2=K \sin (\pi+2\pi/3)$ and $I_3=K \sin (\pi+4\pi/3)$ in the case of an inductor having three windings, K being a constant representative of desired braking force at a position of the magnetic pole or poles of the inductor and the maximum value of K being limited by a maximum intensity of the electric current able to be delivered by each elementary electrical supply.

* * * * *